US008651489B2

(12) United States Patent
Hofstein et al.

(10) Patent No.: US 8,651,489 B2
(45) Date of Patent: Feb. 18, 2014

(54) BLACKJACK GAME WITH SIDE WAGER ON PREDETERMINED HAND

(75) Inventors: Daniel Hofstein, Atlanta, GA (US); Jeff Kimelman, Las Vegas, NV (US)

(73) Assignee: 18 Gaming, LLC, Las Vegas, NV (US)

( * ) Notice: Subject to any disclaimer, the term of this patent is extended or adjusted under 35 U.S.C. 154(b) by 0 days.

(21) Appl. No.: 12/940,139

(22) Filed: Nov. 5, 2010

(65) Prior Publication Data

US 2012/0009986 A1 Jan. 12, 2012

Related U.S. Application Data

(63) Continuation-in-part of application No. 12/854,779, filed on Aug. 11, 2010, now abandoned.

(60) Provisional application No. 61/362,210, filed on Jul. 7, 2010.

(51) Int. Cl.
*A63F 1/00* (2006.01)

(52) U.S. Cl.
USPC ..... 273/292

(58) Field of Classification Search
USPC ..... 273/292
See application file for complete search history.

(56) References Cited

U.S. PATENT DOCUMENTS 5,676,376 A * 10/1997 Valley ..... 273/288
6,352,261 B1 * 3/2002 Brown ..... 273/288
6,446,972 B1 * 9/2002 Brunelle ..... 273/292
6,450,500 B1 * 9/2002 Miller ..... 273/292
6,488,210 B2 * 12/2002 Schumi et al. ..... 235/488
6,692,003 B2 * 2/2004 Potter et al. ..... 273/274
6,752,395 B2 * 6/2004 Jones et al. ..... 273/292
6,789,801 B2 * 9/2004 Snow ..... 273/292
6,805,353 B2 * 10/2004 Williams ..... 273/292
6,808,174 B1 * 10/2004 Rubin ..... 273/292
7,182,901 B2 * 2/2007 Tseng et al. ..... 264/296
7,300,368 B2 * 11/2007 Hylak ..... 473/588
7,309,065 B2 * 12/2007 Yoseloff et al. ..... 273/292
7,354,042 B2 * 4/2008 Moshal ..... 273/292
7,407,162 B2 * 8/2008 Cockrell, Jr. ..... 273/292
7,448,485 B1 * 11/2008 Rutler ..... 194/214
D595,924 S * 7/2009 Haynes ..... D99/34
7,686,307 B1 * 3/2010 Moss ..... 273/292
8,408,387 B2 * 4/2013 Sottile ..... 206/0.82
8,430,403 B1 * 4/2013 Wright ..... 273/148 R
2003/0168807 A1 * 9/2003 Jones et al. ..... 273/292
2004/0108650 A1 * 6/2004 Shibabuki et al. ..... 271/91

* cited by examiner

*Primary Examiner* — Kurt Fernstrom
*Assistant Examiner* — Dolores Collins
(74) *Attorney, Agent, or Firm* — Muskin & Farmer LLC

(57) ABSTRACT

A method to implement a blackjack side wager. The player makes a side wager which buys the player a predetermined point total such as 18. The game then continues and the side wager is resolved as if the player's hand for the side wager was 18, using the same blackjack rules as main wager at the table. If the dealer busts or has a final point total less than 18 the player wins the side wager. If the dealer does not bust and has a final point total greater than 18 the player loses the side wager. If the dealer has a final point total equaling 18 then the player pushes the side wager.

20 Claims, 5 Drawing Sheets

BLACKJACK GAME WITH SIDE WAGER ON PREDETERMINED HAND

CROSS REFERENCE TO RELATED APPLICATIONS

This application is a continuation in part application of application Ser. No. 12/854,779, filed on Aug. 11, 2010, entitled "Blackjack Game with Side Wager on Predetermined Hand" which is incorporated by reference herein in its entirety. This Application also claims benefit to U.S. provisional application 61/362,210, filed on Jul. 7, 2010, entitled, "Blackjack side-bet where the player effectively buys the hand 18 . . . " which is incorporated by reference herein in its entirety.

BACKGROUND OF THE INVENTION

1. Field of the Invention

The present general inventive concept is directed to a method, apparatus, and computer readable storage medium directed to a blackjack game with a side wager on a predetermined hand.

2. Description of the Related Art

The game of blackjack is well known in the art, for example see U.S. patent publication 2003/0155715, which is incorporated by reference herein in its entirety. The goal is to get as close to a point total of 21 without going over 21 (busting).

FIG. 1 is a flowchart of the prior art game of blackjack. The game is played by receiving a main wager in operation 100 by a player placing chips in a betting circle on a gaming table. A dealer then in operation 101 deals a two card hand to each player and the dealer (typically one card face up one card face down). Each player then can then play out their hand (hit or stand) 102 as the player desires. If the player wishes to hit, then the dealer deals 103 the player an additional card. If the players new point total (including the additional card) is determined 104 to be greater than 21, then the player has busted, and the player loses 105 the main wager.

If the player stands 102 then the dealer's hand is resoled 106 according to predetermined rules, such as the dealer can continue hitting until the dealer's point total is 17 upon which the dealer stands. When the dealer's hand is resolved, the dealer's down card is then revealed (turned face up). If it is determined 107 that the dealer busted (the dealer's point total is over 21) then the player wins 110 the main wager.

If the dealer has not busted then the player's final point total (numerical value of all of the player's cards (initial players cards and any cards drawn by that player) added together) is compared to the final dealer's point total (numerical value of all of the dealer's cards (initial dealer's cards plus any cards drawn by the player) added together) to determine 108 who has the higher hand. If the dealer has the higher hand then the player loses 105 the main wager. If the player has the higher hand then the player wins 110 the main wager. If the player's point total equals the dealer's point total then the main wager pushes 109.

The game of blackjack is growing old, and thus what is needed is a blackjack side bet that provides additional excitement to the player.

SUMMARY OF THE INVENTION

It is an aspect of the present invention to provide an exciting casino wagering game.

The above aspects can be obtained by (a) providing a physical deck(s) of cards; (b) providing predefined side wager rules, wherein the predefined side wager rules comprise: i) the player wins the side wager if a dealer's final point total is less than a predetermined point total; ii) the player wins the side wager if the dealer's final point total is over 21; iii) the player loses the side wager if the dealer's final point total is greater than the predetermined point total and less than 22. (c) receiving a main wager and a side wager from a player; (d) dealing, using the physical deck(s) of cards, a player's initial hand and a dealer's initial hand; (e) completing the blackjack game and resolving the main wager according to predetermined blackjack rules; and (f) resolving the side wager according to the predefined side wager rules.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
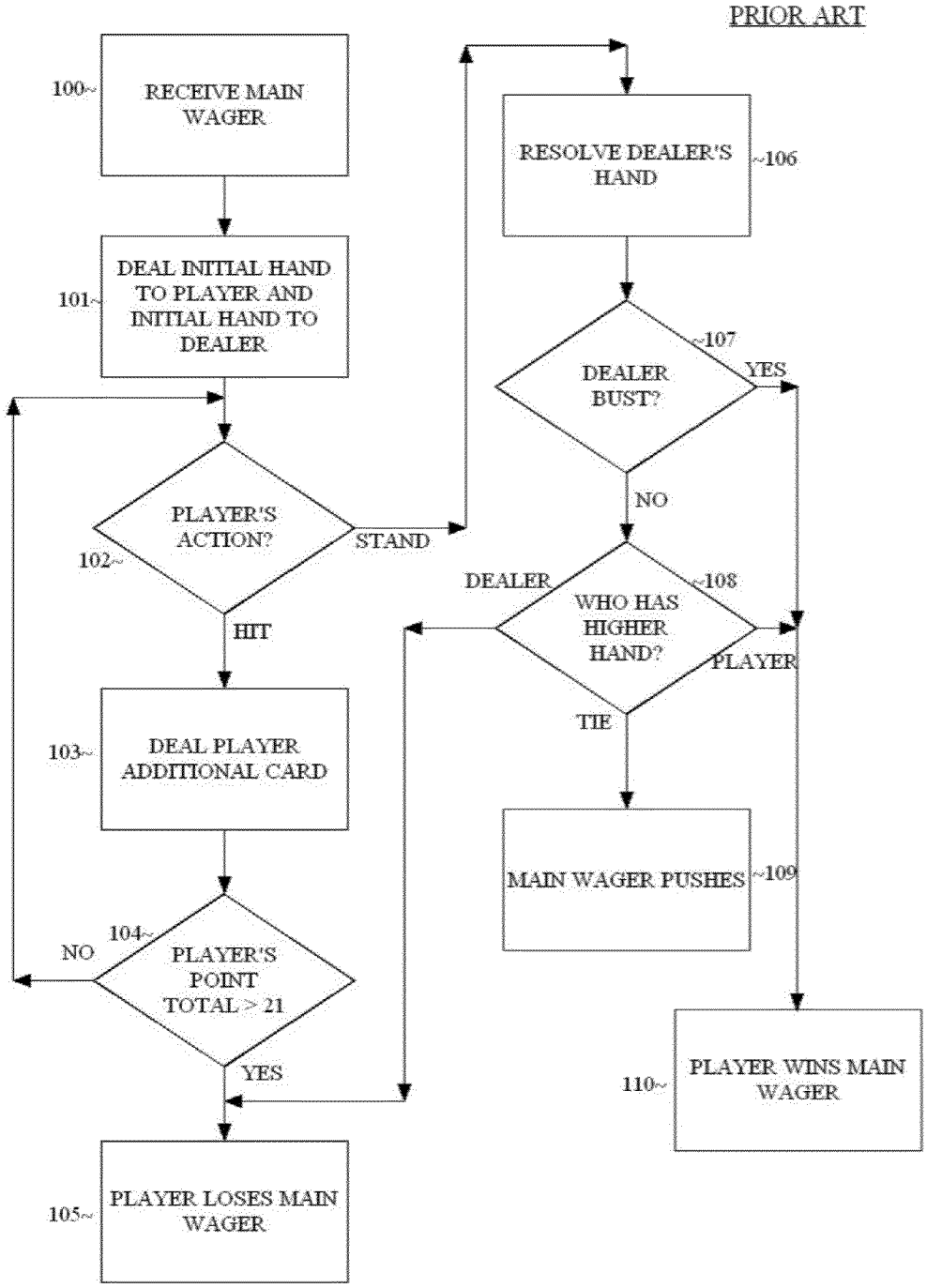
FIG. 1 is a flowchart of the prior art game of blackjack.

Reference will now be made in detail to the presently preferred embodiments of the invention, examples of which are illustrated in the accompanying drawings, wherein like reference numerals refer to like elements throughout.

The present inventive concept relates to a method, apparatus, and computer readable storage medium to implement a side bet for a blackjack game. The side bet is optional to the player (the player must place the main wager but can then optionally place the side bet). Alternatively (according to house rules), the player is not required to place the main wager to play the side bet and can play only the side bet without the main wager if the player desires.

The side bet gives the player a predetermined point total such as 18 (although other predetermined point totals can be used as well). Thus, no additional cards (in addition to the cards used for the main wager/game) are needed for the side bet, the side bet is resolved as if the player has a point total of 18. The main wager is resolved independently of the side bet, and it is possible that the player can lose the main wager and win the side bet, or win the main wager and lose the side bet, win both, or lose both.

Table I below illustrates a payout schedule for the side bet.

TABLE I

| Dealer's final point total | payout |
|---|---|
| Over 21 (bust) | 1:1 (player wins) |
| 19-21 | −1 (player loses) |
| 18 | 0 (tie) |
| 17 | 1:1 (player wins) |

Thus, the side bet can be considered to be a separate bet on a hand of a (final) point total of 18 for the player. It is common for players at a blackjack table to play two hands at the same time (with a separate bet on each), so the side bet can be thought of as if the player is playing a second hand at the same time (but the point total is going to be a predetermined 18). The player cannot hit or stand (or any other action) on the predetermined point total of 18 for the side bet.

Other configurations can be used as well. For example, while Table I refers to the player's side bet having a predetermined point total of 18 (which ties if the dealer also has 18), the player's predetermined point total for the side bet can be other totals (e.g., 17, 19, 20, etc.) as well. Other point totals can have different payout odds. For example, a predetermined point total of 17 can pay 2:1 if the player wins, or a predetermined point total of 20 can pay 1:2 if the payer wins (these numbers are merely examples). Table II below illustrates a payout schedule for a side bet which gives the player a predetermined point total of 19, with a winning payout of X:1 (X can be set by the casino at an appropriate payout level).

TABLE II

| Dealer's final point total | payout |
|---|---|
| Over 21 (bust) | X:1 (player wins) |
| 20-21 | −1 (player loses) |
| 19 | 0 (tie) |
| 17-18 | X:1 (player wins) |

The methods described herein can be applied to numerous different variations of blackjack (e.g., different numbers of decks, early/late surrender allowed, etc.), but applying it to a game using a six standard-deck show when the dealer hits soft 17, the house will win an average of 2.03% of the side wager (assuming the payouts in Table I where 18 is the predetermined point total).

In a further embodiment, the predetermined point total given to the player can be between two integer totals. For example, the predetermined point total can include (contain) a half point such as 17½, 18½, 19½, or 20½. Using a half point allows the player to win on a tie. For example, if the predetermined point total is 18½, then the side bet would win if the dealer has 18 and lose if the dealer has 19. Table III below illustrates a payout schedule for a side bet which gives the player a predetermined point total of 18½. Y represents a payout that can be chosen by the house based on the house preferences and mathematics involved (for example 1). In this embodiment, there are no ties between the player and the house. It is noted that using typical blackjack rules, a dealer point total of under 17 would not be possible.

TABLE III

| Dealer's final point total | payout |
|---|---|
| Over 21 (bust) | Y:1 (player wins) |
| 19-21 | −1 (player loses) |
| 17-18 | Y:1 (player wins) |

Figure 2:
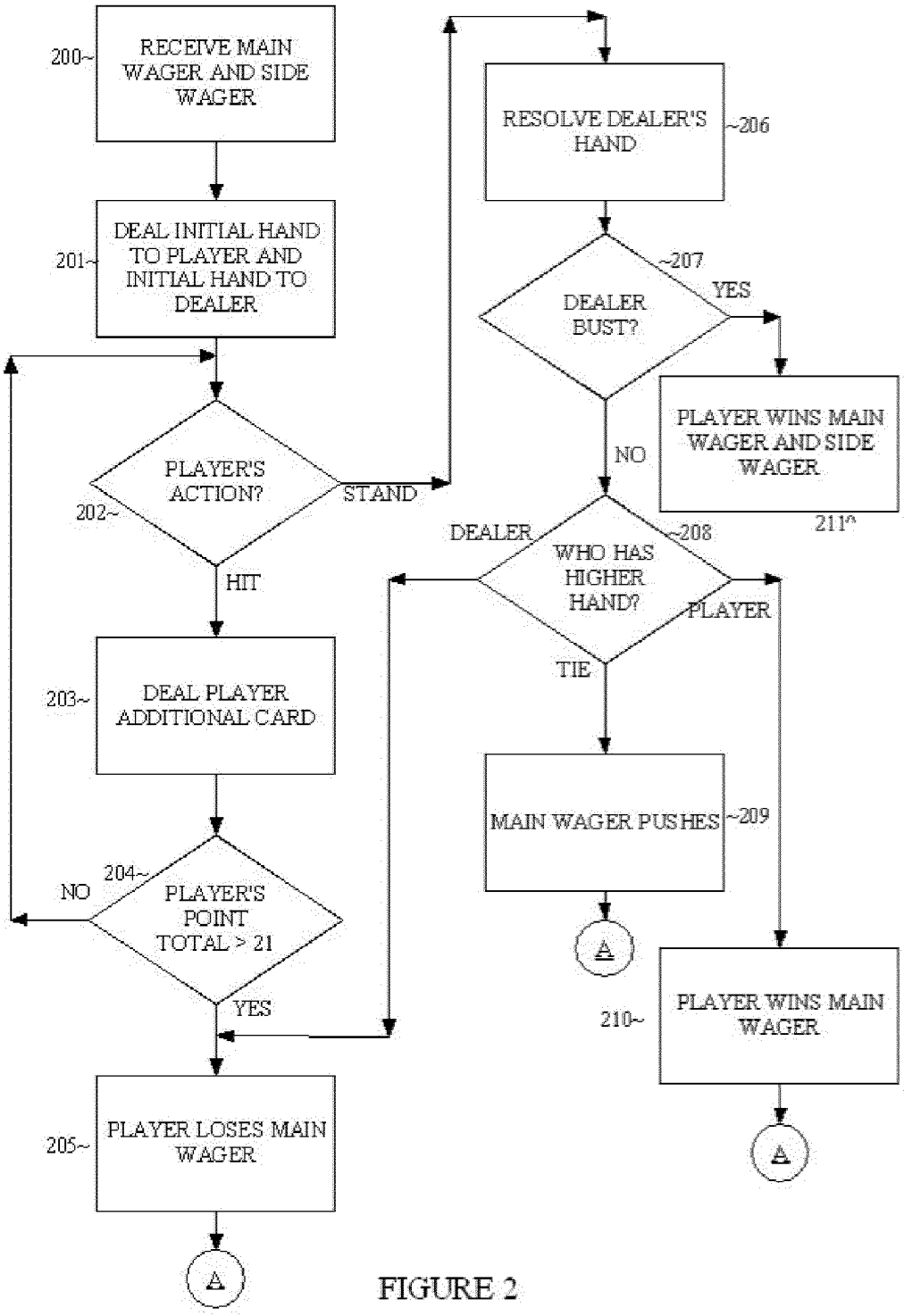
FIG. 2 is an exemplary flowchart illustrating a method of implementing a blackjack side bet, according to an embodiment.

FIG. 2 is an exemplary flowchart illustrating a method of implementing a blackjack side bet, according to an embodiment.

FIG. 2 is similar to FIG. 1, but can accommodate the side bet as described herein. In operation 200, the player can place the main wager and/or the side bet (or side wager). The blocks in FIG. 2 (201, 202, 203, 204, 205, 206, 207, 208, 209, 210) are analogous to their counterparts in FIG. 1.

Figure 3:
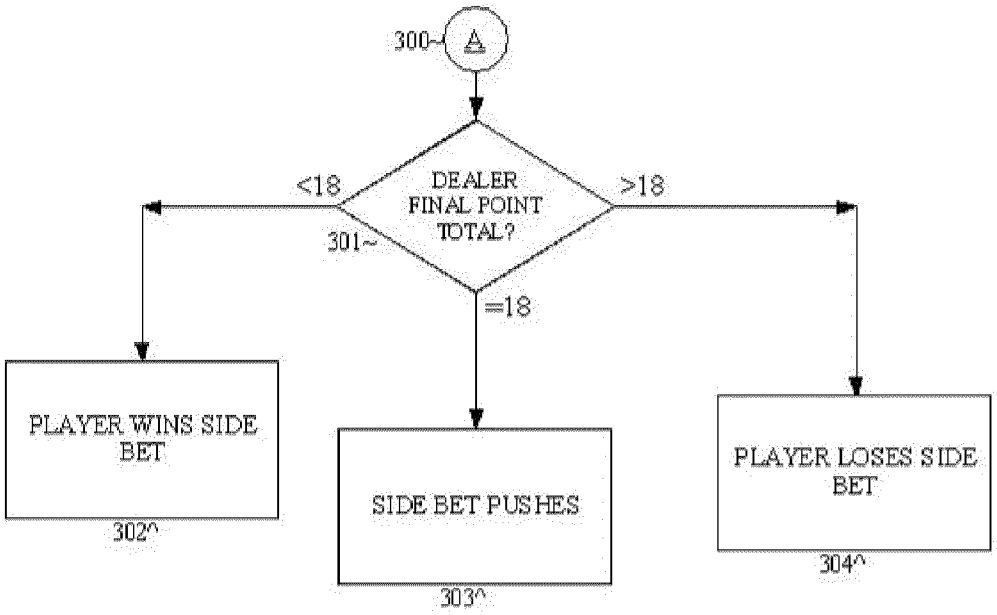
FIG. 3 is an exemplary flowchart illustrating a method of resolving a blackjack side bet, according to an embodiment.

After the player busts (operation 205), or the main wager pushes (operation 209) or the player wins the main wager (operation 210) then the method can proceed to connector A which continues to FIG. 3. If the player did not bust and it is determined that the dealer busts (in operation 207), then in operation 211 the player wins both the main wager and the side bet (because the player's point total of 18 on the side bet beats a dealer's bust).

While not illustrated in FIG. 2, the player can have other options known in blackjack as well, such as doubling, splitting, etc. However, options such as doubling and splitting typically cannot be applied to the side bet.

FIG. 3 is an exemplary flowchart illustrating a method of resolving a blackjack side bet, according to an embodiment. Note that if the dealer has busted (the dealer's final point total is over 21), then the method would not make it to FIG. 3 but would have ended at operation 211, FIG. 2 in which the player would win the side wager.

From connector A 300, the method proceeds to operation 301, which evaluates the dealer's final point total. If the dealer's final point total is greater than 18, then method proceeds to operation 304, wherein the player loses the side bet (but the dealer could not have busted here. If the dealer busted, then the player wins the side bet in operation 211). Thus, in operation 304, the dealer's point total must be 19-21 (which beats the player's predetermined side bet total of 18). If the dealer's final point total equals 18, then the method proceeds to operation 303 wherein the side bet pushes. If the dealer's final point total is less than 18, then the method proceeds to operation 302 wherein the player wins the side bet (typically the player wins an even money payout (1:1) although other payouts can be used as well).

It is noted that the logical order of FIGS. 2-3 are just one example of how the main wager and the side wager can be resolved, but the resolution of the bets can be accomplished in other orders as well. For example, the dealer may wish to resolve the side wager first and then the main wager. Numerous different resolution orders and logical flowcharts can be used to effectuate the side wager.

An example of the game will now be presented (with the predetermined point total being 18 for the side bet). Rodney places a $1 main wager and a $2 side wager (also referred to as "side bet" herein). Rodney is dealt a 10 and a 6 (suits do not matter here), and the dealer's up-card is a 5 (the dealer's "hole card" is not shown). The player decides to stand. The dealer reveals the dealer's hole card to be a 10 and then draws and pulls a 2. Thus, the player's final point total is 16 and the dealer's final point total is 17. According to the blackjack rules (see FIG. 2), the player loses the main wager because the dealer's point total is higher than the player's point total (and the dealer did not bust). According to the rules of the side wager (see FIGS. 2-3), since the player's predetermined point total of 18 is greater than the dealer's final point total of 17, the player wins the side wager (see Table I). Thus, Rodney loses his $1 main wager (which is taken by the dealer) but wins his $2 side wager (which is paid $2 by the dealer). Thus, Rodney now has $4 in chips on the table which Rodney can keep (or re-bet). Since Rodney originally bet a total of $3, Rodney has made a $1 profit. Of course, Rodney could have decided to hit his 16 instead of standing, since the player plays out his hand normally regardless of whether the player made the side wager or not.

As another example, suppose Olivia places a $1 side wager but declines to make the main wager (this may or may not be allowed depending on house rules). Olivia is not dealt any cards in this instance (alternatively, the dealer can deal Olivia two initial cards which would not be used to resolve the side wager just in order not to interrupt the flow of cards). The dealer's up-card is an ace. Olivia does nothing (there is no action that can be taken regarding the side wager and Olivia did not make a main wager), and the dealer then reveals the dealer's down-card (hole-card) to be an 8. The dealer thus has a final point total of 19, which beats the player's predetermined point total of 18. Thus, Olivia loses her $1 side wager (see Table I).

Figure 4A:
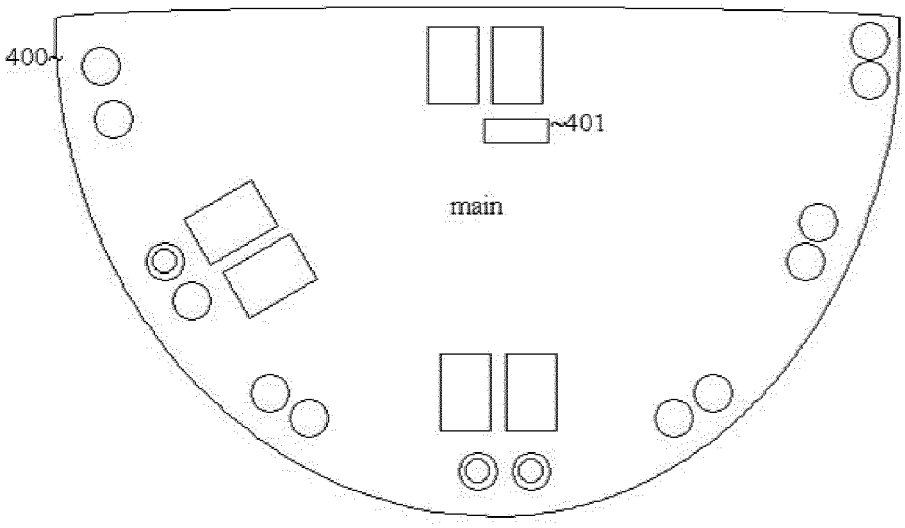
FIG. 4A is an exemplary table layout of a blackjack side bet, according to an embodiment.

FIG. 4A is an exemplary table layout of a blackjack side bet, according to an embodiment.

A physical gaming table 400 is used to play the game. The gaming table 400 can comprise a top felt layer which has the betting circles imprinted thereon. Other gaming equipment can be used as well such as a card shuffler, deck(s) of cards (from one deck to eight decks or more), a card show, chip racks, etc. The dealer's area can also accommodate a physical card reader for reading the dealer's hole card as described in U.S. Pat. No. 5,681,039, which is incorporated by reference in its entirety for all purposes.

Shown in FIG. 4A are two players (each with a hand of two cards) playing simultaneously at the table against the dealer (with a hand of two cards). The leftmost player is only playing the main wager (as evidenced by a chip only in the left betting circle), while the other player is playing both the main wager and the side wager (as evidenced by a chip in both betting circles).

Figure 4B:
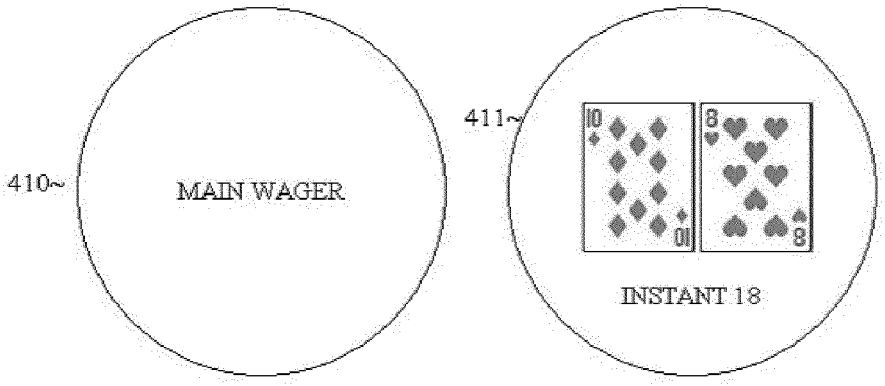
FIG. 4B is an exemplary close up of betting circles for an individual player, according to an embodiment.

FIG. 4B is an exemplary close up of betting circles for an individual player, according to an embodiment.

Each of the playing areas in FIG. 4A comprises two betting circles, which hare enlarged in FIG. 4B. A main wager betting circle 410 is used by players to place the main wager while a side bet betting circle 411 is used by players to place the side bet. In FIG. 4B, the side bet betting circle 411 has printed therein indicia of a player's two cards that total 18. Also imprinted inside the side bet betting circle 411 is a name of the side bet, in this case "INSTANT 18."

Figure 5A:
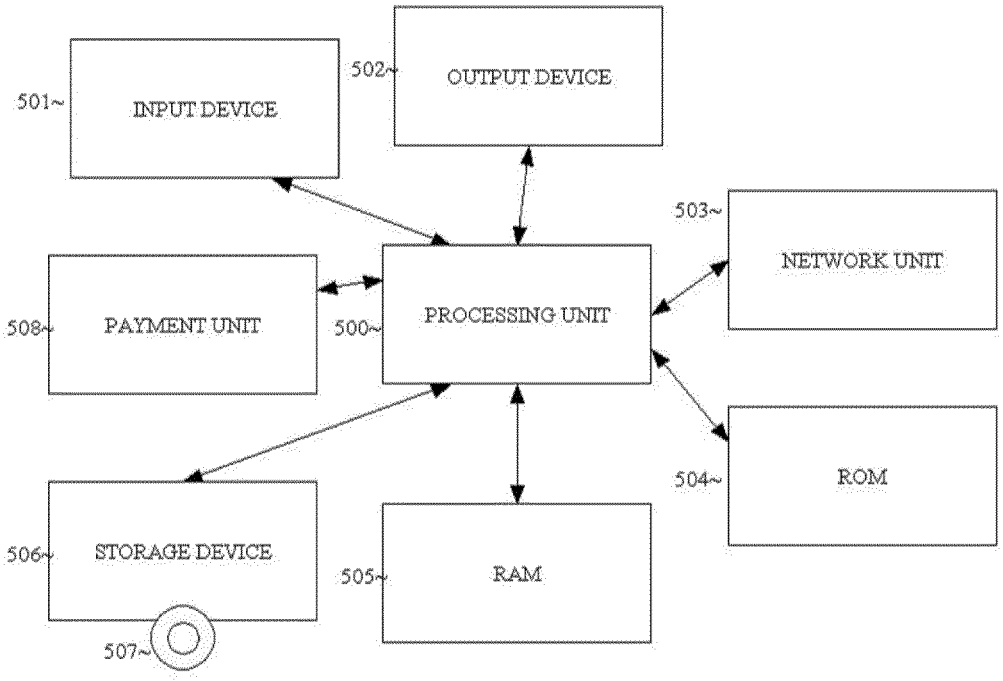
FIG. 5A is an exemplary block diagram illustrating hardware that can be used to implement an electronic version of methods described herein, according to an embodiment.

FIG. 5A is an exemplary block diagram illustrating hardware that can be used to implement an electronic version of methods described herein, according to an embodiment.

A processing unit 500 can be a microprocessor and any associated units (e.g., cache, bus, etc.) The processing unit 500 can be connected to an input device 501 (e.g., touch-screen, keyboard, mouse, buttons, etc.) and an output device 502 (e.g., touch-screen, speakers, CRT, LCD, etc.) The processing unit 500 can also be connected to a network unit 503 which can connect to any type of computer communication network (e.g., Internet, WAN, LAN, Wifi, etc.) The processing unit 500 can also be connected to a ROM 504 and a RAM 505. The processing unit 500 can also be connected to a storage device 506 (e.g., BLU-RAY drive, disk drive, hard drive, EPROM, CD-ROM, etc.) that can read a computer readable storage medium 507 (e.g., BLU-RAY disc, CD-ROM, etc.) which can store assets and programs to control a computer to implement any of the methods described herein. The processing unit 500 can also be connected to a payment unit 508 which can comprise a bill or cashless ticket acceptor, e-payment acceptor, etc. The payment unit 508 can also make payment to the player (upon cashout) in the form of a coin dispenser, cashless ticket dispenser, e-payment unit, etc.

Figure 5B:
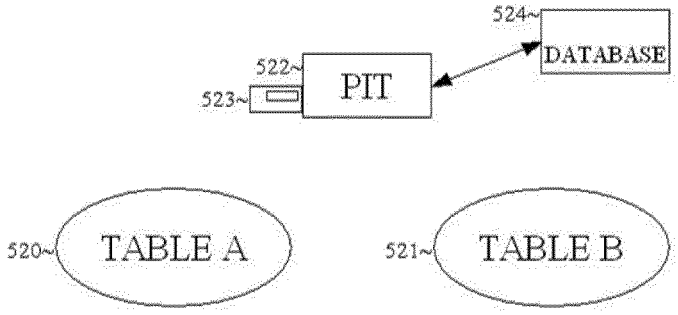
FIG. 5B is an exemplary block diagram illustrating an electronic database system that can be used to track and store player playing history, according to an embodiment.

FIG. 5B is an exemplary block diagram illustrating an electronic database system that can be used to track and store player playing history, according to an embodiment.

When players play casino table games the casino can typically track the player so that the casino knows how much gaming action a player is giving the casino and hence how much to reward each player with complimentaries (free or discounted rooms, food, etc.) Such a system is described in U.S. Pat. No. 5,836,817, which is incorporated by reference herein in its entirety for all purposes.

A gaming table A 520 and a gaming table B 521 can be associated with a pit 522 which has a card reader to read the electronically encoded information on a player's card (alternatively the card reader can be located at the tables themselves). Casino employees can enter data regarding each player's play (for those players that present a players card) into a computer (not pictured) which transmits the play data (e.g., average bet amount, time of play, etc.) to an electronic casino database 524 that stores playing history information for players at the casino.

The methods described herein can be applied to any version of blackjack, such as "Spanish 21", blackjack with a wild card, etc. The methods described herein can also be used with any kind of deck(s) of cards, such as a standard deck of 52 cards, a deck with wild card(s), a Spanish deck (10's removed), etc. Cards are given their standard numerical face value (i.e., aces count as 1 or 11, two's count as 2, three's count as 3' four's count as 4, five's count as 5, six's count as 6, seven's count as 7, eight's count as 8, nine's count as 9, tens and jacks and queens and kings count as 10). Typically aces in the player's hand count as either 1 or 11 at the player's option. Aces in the dealer's hand can also count as either 1 or 11 and which value is used is dependent upon house rules when resolving the blackjack hand (typically the highest value possible without causing the dealer to break). When the dealer resolves the dealer's hand, any house way can be used, for example the dealer can continue to hit until the dealer's point total is a hard 17 or soft 18 (dealer hits soft 17), or alternatively the dealer can stand on soft 17.

The methods herein can be played in physical form using physical cards, tables, chips which can be directly redeemable for cash. The methods herein can also be played on electronic form, such as an Internet casino, electronic gaming machine, home computer, etc.

Any description of a component or embodiment herein also includes hardware, software, and configurations which already exist in the prior art and may be necessary to the operation of such component(s) or embodiment(s).

Further, the operations described herein can be performed in any sensible order. Any operations not required for proper operation can be optional. Further, all methods described herein can also be stored on a computer readable storage to control a computer.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A method for playing a blackjack game, the method comprising:

executing on an electronic processor, the following operations:

providing predefined side wager rules, wherein the predefined side wager rules comprise: a) the player wins the side wager if a dealer's final point total is less than a predetermined point total; b) the player wins the side wager if the dealer's final point total is over 21; c) the player loses the side wager if the dealer's final point total is greater than the predetermined point total and less than 22;

receiving a main wager and a side wager from a player;

dealing a player's initial hand and a dealer's initial hand;

completing the blackjack game and resolving the main wager according to predetermined blackjack rules; and resolving the side wager according to the predefined side wager rules, wherein resolution of the side wager is performed without any consideration of the player's initial hand.

2. The method as recited in claim 1, wherein the predetermined point total is 18.

3. The method as recited in claim 2, wherein the predefined side wager rules further comprise that the side wager ties if the dealer's final point total equals the predetermined point total.

4. The method as recited in claim 2, wherein if the player wins the side wager then the player is paid 1:1 on the side wager.

5. The method as recited in claim 1, wherein the predefined side wager rules further comprise that the side wager ties if the dealer's final point total equals the predetermined point total.

6. The method as recited in claim 1, wherein if the player wins the side wager then the player is paid 1:1 on the side wager.

7. The method as recited in claim 1, wherein the predetermined point total is printed on a side wager betting circle on a felt on a gaming table used for the game.

8. The method as recited in claim 1, wherein the predetermined point total is 18½.

9. The method as recited in claim 1, wherein the predetermined point total contains a fraction of a point.

10. An electronic apparatus for playing a blackjack game, the apparatus comprising:

an input device;

an output device;

a processor connected to the input device and the output device, the processor programmed to:

provide predefined side wager rules, wherein the predefined side wager rules comprise: a) the player wins the side wager if a dealer's final point total is less than a predetermined point total; b) the player wins the side wager if the dealer's final point total is over 21; c) the player loses the side wager if the dealer's final point total is greater than the predetermined point total and less than 22;

receive a main wager and a side wager from a player; dealing, using the physical deck(s) of cards, a player's initial hand and a dealer's initial hand;

complete the blackjack game and resolving the main wager according to predetermined blackjack rules; and resolve the side wager according to the predefined side wager rules, wherein resolution of the side wager is performed without any consideration of the player's initial hand.

11. The apparatus as recited in claim 10, wherein the predetermined point total is 18.

12. The apparatus as recited in claim 11, wherein the predefined side wager rules further comprise that the side wager ties if the dealer's final point total equals the predetermined point total.

13. The apparatus as recited in claim 12, wherein if the player wins the side wager then the player is paid 1:1 on the side wager.

14. The apparatus as recited in claim 10, wherein the predefined side wager rules further comprise that the side wager ties if the dealer's final point total equals the predetermined point total.

15. The apparatus as recited in claim 10, wherein if the player wins the side wager then the player is paid 1:1 on the side wager.

16. The method as recited in claim 10, wherein the predetermined point total is 18½.

17. The method as recited in claim 10, wherein the predetermined point total contains a fraction of a point.

18. A method for playing a blackjack game, the method comprising:

executing on an electronic processor, the following operations:

receiving a main wager and a side wager from a player;

dealing, a player's initial hand and a dealer's initial hand;

completing the blackjack game and resolving the main wager according to predetermined blackjack rules;

wherein if a dealer's final point total is less than a predetermined point total then paying the player a payout on the side wager, wherein if the dealer's final point total is over 21 then paying the player a payout on the side wager, wherein if the dealer's final point total is greater than the predetermined point total and less than 22 then taking the side wager from the player, wherein resolution of the side wager is performed without any consideration of the player's initial hand.

19. The method as recited in claim 18, wherein the predetermined point total is 18.

20. The method as recited in claim 19, wherein if the dealer's final point total equals the predetermined point total then the side wager pushes.

* * * * *